US005982097A

United States Patent [19]

Mehrotra et al.

[11] Patent Number: 5,982,097

[45] Date of Patent: Nov. 9, 1999

[54] HOLLOW ELECTRODES FOR LOW PRESSURE DISCHARGE LAMPS, PARTICULARLY NARROW DIAMETER FLUORESCENT AND NEON LAMPS AND LAMPS CONTAINING THE SAME

[75] Inventors: Vivek Mehrotra, Rye Brook; Thomas F. McGee; Susan McGee, both of Peekskill, all of N.Y.; Jeroen Langevoort, Gulpen; Edward Young, Maastricht, both of Netherlands

[73] Assignee: Philips Electronics North America Corporation, New York, N.Y.

[ * ] Notice: This patent is subject to a terminal disclaimer.

[21] Appl. No.: 08/581,237

[22] Filed: Dec. 29, 1995

[51] Int. Cl.[6] ..... H01J 61/04

[52] U.S. Cl. ..... 313/631; 313/491; 313/632; 313/633; 313/346 R

[58] Field of Search ..... 313/491, 631, 313/632, 633, 310, 346 R, 352, 355, 356

[56] References Cited

U.S. PATENT DOCUMENTS

| | | | |
|---|---|---|---|
| 2,686,274 | 8/1954 | Rooksby | 313/212 |
| 2,806,970 | 9/1957 | Meister et al. | 313/109 |
| 2,911,376 | 11/1959 | Rudolph | 252/521 |
| 3,563,797 | 2/1971 | Young et al. | 117/223 |
| 3,953,376 | 4/1976 | Kern | 252/521 |
| 3,969,279 | 7/1976 | Kern | 252/521 |
| 4,031,426 | 6/1977 | Kern | 313/346 R |
| 4,409,517 | 10/1983 | Van Der Sande et al. | 313/631 |
| 4,797,593 | 1/1989 | Saito et al. | 313/346 R |
| 5,103,133 | 4/1992 | Misomo | 313/491 |
| 5,111,108 | 5/1992 | Goodman et al. | 313/630 |
| 5,258,687 | 11/1993 | Duggan et al. | 313/346 |
| 5,387,837 | 2/1995 | Roelevink et al. | 343/484 |

FOREIGN PATENT DOCUMENTS 263634 10/1960 Australia .

*Primary Examiner*—Nimeshkumar Patel
*Attorney, Agent, or Firm*—Ernestine C. Bartlett

[57] ABSTRACT

Novel emitter materials, electrode assemblies amd lamps comprisinfg the same are provided in which, in accordance with the invention, novel electrodes are provided having a lamp electrode structure, preferably including a hollow ferrule for sealing in a lamp to permit evacuation; an emitter material of the invention on at least one surface thereof, preferably on a protrusion attached to the hollow ferrule; a thermal isolator, preferably in the form of a low thermal conductivity wire or an incised or cut-out portion of the hollow ferrule body, for thermally isolating the protrusion from the ferrule to maintain a sufficiently high temperature for thermionic emission, and further comprising an emitter material requiring no in-lamp processing. The emitter materials are a mixed oxide of Ba, Sr and mixtures thereof with one or more of the metals from the series comprising Ta, Ti, Zr, Sc, Y, and La, are preferably selected from the group consisting of $Ba_4Ta_2O_9$, $Ba_5Ta_4O_{15}$, $BaY_2O_4$, $BaCeO_3$, $Ba_xSr_{1-x}Y_2O_4$, $Ba_2TiO_4$, $BaZrO_3$, $Ba_xSr_{1-x}TiO_3$, and $Ba_xSr_{1-x}ZrO_3$, wherein x ranges from a value of 0 to 1, and are most preferably one or more mixed oxides selected from the group consisting of $Ba_4Ta_2O_9$, $BaY_2O_4$, $BaCeO_3$, $Ba_{0.5}Sr_{0.5}Y_2O_4$, $Ba_{0.75}Sr_{0.25}Y_2O_4$, $Ba_2TiO_4$, $BaZrO_3$, $Ba_{0.5}Sr_{0.5}TiO_3$, and $Ba_{0.5}Sr_{0.5}ZrO_3$.

25 Claims, 3 Drawing Sheets

HOLLOW ELECTRODES FOR LOW PRESSURE DISCHARGE LAMPS, PARTICULARLY NARROW DIAMETER FLUORESCENT AND NEON LAMPS AND LAMPS CONTAINING THE SAME

FIELD OF THE INVENTION

This invention relates to electrodes for low pressure discharge lamps, particularly narrow diameter (ND) fluorescent and neon lamps, and to such lamps containing such electrodes. More specifically, the invention relates to a low-pressure discharge lamp comprising a tubular glass lamp envelope which is closed in a vacuum tight manner and which contains an ionizable filling and hollow cylindrical electrodes in the lamp envelope.

BACKGROUND OF THE INVENTION

Such a lamp is known from EP-A 0 562 679 which corresponds substantially to U.S. Pat. No. 5,387,837, commonly assigned herewith. The known lamp is of small internal diameter, for example 1.5 to 7 mm, and of a long length and, when filled with neon, for example, may be used for example as a signal lamp such as a tail lamp in automobiles, and has the advantage over an incandescent lamp that it emits its full light after 10 ms instead of 300 ms after being energized. A disadvantage of the known lamp is that its luminous flux and efficacy is comparatively low.

Presently, only low current and low wattage ND fluorescent lamps are available. These lamps have a relatively high cathode fall of about 180 volts and their light output is rather low (<900 lm/m). Typically, axially configured, emitterless and hollow Fe—Cr—Ni electrodes (ferrules) are used in ND fluorescent lamps.

The high cathode fall (~180 volts) and high work function of axially configured, emitterless and hollow electrodes typically used in ND fluorescent lamps limit their use to lamp currents of less than 10 to 15 mA. Lower current results in a low light output (<900 lm/m) and the high cathode fall reduces the lamp efficacy. High current ND fluorescent and neon lamps are highly desirable yet are non-existent. No electrodes are presently available for instant start ND fluorescent lamps with a current between 20 and 50 mA. The requirement for such lamps, among others, is a low cathode fall of, for example, less than 80 volts. There is therefore a need in the art for high current and high efficacy ND lamps. Such higher current ND fluorescent lamps may be used in automobile interior lighting or as backlights in laptop computers.

The cathode fall of an electrode in a lamp can be reduced by promoting electron emission. In traditional larger diameter and high current (>200 mA) fluorescent lamps, a tungsten coil coated with triple carbonates (for example a mixture of barium, strontium and calcium carbonates) is used as the electrode. Consequently, these lamps have four terminals, two for each electrode on either side. During lamp manufacturing, in an extra process step, the carbonates are thermally converted into oxides in the lamp by passing a current through the tungsten coil. In the lamp, these oxides [(Ba,Sr,Ca)O] promote electron emission via thermionic emission when the electrode is heated to 1000–1300° C., either by passing a heating current through the tungsten coil or by ion-bombardment. It would be desirable to have novel electrodes which do not require the extra thermal in-lamp processing step during manufacture, particularly since the step requires expensive processing time.

The electrodes presently used in instant start fluorescent and T2 lamps require a preheating current through the tungsten coil for optimum operation, thereby requiring a heating circuit in the ballast. It would be desirable to have novel electrodes which do not require a preheating current and in which the heating circuit could be eliminated from the ballast thereby lowering its cost. In these instant start lamps, electrode heating occurs during ignition due to ion-bombardment from the discharge. Therefore, the electrodes for instant start operation must withstand the sputtering. Such an electrode in which no in-lamp processing is required simplifies lamp manufacture and increases the lamp production rates.

An ND lamp requires single-lead electrodes because of geometrical constraints and therefore ion-bombardment is the only source of cathode heating. Due to the absence of a coil the use of carbonates in single-lead ND lamps would require external RF heating to convert them to oxides during manufacturing. This adds an additional, even more costly step to the manufacturing process. Therefore, new emitters, which do not need any in-lamp processing, are even more desirable for ND lamp electrodes.

Depending on the emitter used, a minimum temperature is necessary for electron emission. This temperature cannot be easily obtained in low-pressure discharge lamps, and especially ND lamps operating at low currents. Additionally, for ND lamp electrodes, the nature of the electron emission may be thermionic and/or secondary. Thermionic emission depends on the temperature and electric field. On the other hand, secondary emission depends on the ion current and temperature. Field emission is a third possibility for ND lamp electrodes and is dependent upon the strength of the electric field in front of the cathode. Ideally, the thermal conductivity of the electrodes should be low (<20 watts/mK) such that the temperature of the glass feedthrough seal is sufficiently low. Low thermal conductivity will also allow the emitting surface to attain the thermionic emission temperature in the shortest possible time and therefore reduce lamp-blackening during starting. The electrical resistivity should be low to minimize resistive heat losses.

SUMMARY OF THE INVENTION

An object of the invention is to provide electrodes comprising novel emitter materials.

Another object of the invention is to provide electrodes having emitters which do not require any in-lamp processing.

Another object of the invention is to provide novel electrodes that are suitable for use in low pressure discharge lamps and especially ND lamps and that make it possible to provide novel high current, and high efficacy lamps.

Another object of the invention is to provide a low pressure discharge lamp which is capable of providing an increased luminous flux.

Another object of the invention is to provide novel electrodes and ND fluorescent lamps with 3.5 mm inner diameter or less in the 30–50 mA current range resulting in a lumen flux of >1200 lm/m and 10–50 mA ND neon lamps with cathode falls of less than 80 volts and preferably about 30 volts.

Another object of the invention is to provide novel electrodes for single lead narrow diameter lamps with low cathode falls.

Another object of the invention is to provide novel electrodes for high lumen output T1, T2 and compact fluorescent and neon lamps and lamps containing the same.

A further object of the invention is to provide novel electrodes that may be tailored to provide the characteristics needed, as desired, that are suitable for use in a wide variety of lamp types including narrow diameter fluorescent lamps and to provide lamps derived therefrom.

A further object of the invention is to provide novel electrodes which do not require costly heating circuits in the ballasts.

These and other objects are achieved by the present invention as will be apparent in view of the description of the invention which follows.

It has now been found that low pressure discharge lamps, particularly high current and high efficacy ND fluorescent and neon lamps and instant start ND lamps, may be provided and the solutions to the problems involved in providing such lamps may be realized by a suitable choice of an electron emitter combined with the geometrical design of the electrode.

According to the present invention, electrodes are provided which are suitable for use in high current, ND fluorescent or T1 (2–5 mm diameter) lamps in different current regimes, for example 10–100 mA; T2 (6.5 mm diameter) fluorescent lamps in the 10–200 mA range; compact fluorescent lamps in the 100–300 mA range; and instant start T12 lamps in the 200–350 mA range. Electrodes are also provided for use in high current neon lamps, with lamp diameters in the range 2–5 mm and current in the range 10–50 mA. Such lamps are useful for tail or brakelight automobile applications.

According to the invention, at least two electrodes extend into the sealed envelope of a lamp and are adapted to have an arc discharge maintained between them, at least one of the two said electrodes being a hollow cylindrical electrode of a refractory metal or a hollow cylindrical electrode having a protrusion attached thereto, bearing on at least one of its surfaces an emissive material selected from one or more mixed oxides of Ba, Sr and mixtures thereof with one or more of the metals from the series comprising Ta, Ti, Zr and/or with one or more of several rare earths such as Sc, Y, and La, (the lanthanides).

Preferably, such emitter materials are mixed oxides selected from the group consisting of $Ba_4Ta_2O_9$, $Ba_5Ta_4O_{15}$, $BaY_2O_4$, $BaCeO_3$, $Ba_xSr_{1-x}Y_2O_4$ wherein x ranges from a value of 0 to 1; $Ba_2TiO_4$, $BaZrO_3$, $Ba_xSr_{1-x}TiO_3$ wherein x ranges from a value of 0 to 1, and $Ba_xSr_{1-x}ZrO_3$ wherein x ranges from a value of 0 to 1.

Most preferably, the emitter materials are selected from the group consisting of $Ba_4Ta_2O_9$, $BaY_2O_4$, $BaCeO_3$, $Ba_{0.5}Sr_{0.5}Y_2O_4$, $Ba_{0.75}Sr_{0.25}Y_2O_4$, $Ba_2TiO_4$, $BaZrO_3$, $Ba_{0.5}Sr_{0.5}TiO_3$, and $Ba_{0.5}Sr_{0.5}ZrO_3$.

Depending on the desired end use, the hollow cylindrical electrode(s) may be of varied shape and form. In preferred embodiments of the invention:

(a) the hollow cylindrical electrode (i.e., ferrule) is formed from a high temperature resistant alloy such as Fe—Ni—Cr, or a refractory metal such as molybdenum, tungsten, tantalum and alloys thereof, and has an emissive material of the invention on at least one of its surfaces as illustrated in FIG. 3. The Fe—Ni—Cr alloys have a chrome oxide layer to make a glass-to-metal seal and therefore also serve as a feedthrough during lamp making. The hollow Fe—Ni—Cr tubes can be used as electrodes in ND fluorescent and neon lamps. The refractory metals or alloys are particularly suitable for use in compact fluorescent and other higher current lamps. It has been found that as the lamp current is increased, the electrode operating temperature rises and therefore electrode materials with low vapor pressure are required to prevent end-blackening of glass walls. The refractory hollow tubes satisfy this requirement and may be attached to a suitable feedthrough for lamp making; and/or (b) the hollow cylindrical electrode (ferrule) has a hollow protusion bearing an emitter material on at least one of its surfaces attached thereto, said protrusion being attached to the ferrule via a thermal isolator such as a low thermal conductivity wire as illustrated in FIGS. 2 and 4. Preferably, a Ni80-Cr20 wire, with a thermal conductivity of about 13.4 W/mK and a wire diameter of 125 or 250 $\mu$m is used as the thermal isolator. The wire limits the heat conduction losses, thereby raising the tip temperature at the protrusion to bring the emitter coated or filled protrusion to a sufficiently high temperature that thermionic emission occurs thereby lowering the cathode fall. The protrusion may be completely filled with emitter or it may be hollow with emitter on at least one of its surfaces; and/or (c) the hollow cylindrical electrode (ferrule) has a protrusion attached thereto, said protrusion having a receptacle portion, preferably a crimped portion containing an emitter material, said protrusion being attached to the ferrule via a thermal isolator such as a low thermal conductivity wire as illustrated in FIG. 5; and/or (d) the hollow cylindrical electrode (ferrule), preferably made of Fe—Ni—Cr alloy, has a hollow protrusion attached thereto, the protrusion and the ferrule being integrally formed, the protrusion being connected to the ferrule by material remaining after removal of material from the cylindrical ferrule by incision such as by sawing, grinding, drilling, etching, etc., as illustrated in FIG. 6. The emitter material is preferably contained in the protrusion part of the ferrule after making the incision; and/or combinations of one or more of such structures or portions thereof may be used.

In accordance with the invention, novel electrodes are provided having a lamp electrode structure, preferably including a hollow ferrule for sealing in a lamp to permit evacuation; an emitter material of the invention on at least one surface thereof, preferably on the protrusion attached to the hollow ferrule; a thermal isolator, preferably in the form of a low thermal conductivity wire or an incised or cut-out portion of the hollow ferrule body, for thermally isolating the protrusion from the ferrule to maintain a sufficiently high temperature for thermionic emission, and further comprising an emitter material requiring no in-lamp processing.

Such electrodes in preferred embodiments combine the concepts of (1) geometrical design in which a thermal isolator and protrusion is used to optimize the electrode tip temperature; and (2) providing, preferably by coating or filling at least a portion of the protrusion isolator with an emitter, preferably an emitter which comprises barium mixed oxides with suitable thermionic and/or secondary emission properties. It has been found that this combination maximizes the electron emission from the electrode at low temperatures resulting in low cathode falls and thus a high efficacy and high lumen output ND lamp is obtained.

In preferred embodiments of the invention, with reference to the Figures, a protrusion (20) is attached to a hollow ferrule (30) such as for example, a Fe—Ni—Cr electrode, via a low thermal conductivity wire (40) or by a bridge portion (140) made by an incision or cut-out portion (170) which acts as a thermal isolator. The protrusion (20) material can be Fe—Ni—Cr alloy or a refractory metal such as molybdenum, tungsten, tantalum or alloys thereof. Attachment of the protrusion to the thermal isolator wire which is further attached to the hollow ferrule may be by any means including laser or resistance welding, etc. The protrusion and/or incised or cut-out portion is filled or coated with emitter material (50) on at least one of the surfaces which is so selected that no heat treatment in the lamp is required. The protrusion achieves a sufficiently high temperature during lamp operation resulting in a good electron emission. The thermal isolator provides the protrusion with a thermal insulation so that the ferrule itself remains comparatively cool, especially at the glass-ferrule junction. This manifests itself in the temperature of the electrode at the area where it makes contact with the lamp envelope, and outside the lamp envelope. The lamp envelope as a result may be in contact with or in connection with materials which have a comparatively low resistance to heat during operation, such as inexpensive plastics.

In the arrangement shown in FIG. 3, where there is no protrusion, the emitter material is contained in the ferrule and this arrangement is restricted to use with low lamp currents such as, for example, 10 mA. At higher lamp currents, this particular electrode gets unacceptably hot.

The advantages of a hollow ferrule are preserved in this geometrical arrangement in that lamp evacuation and back-filling can be performed through the hollow ferrule and the glass seals can be made directly on the ferrule.

Various types of protrusion materials in tubular form may be used. The protrusion may be of the same composition as the ferrule itself or different and may be a refractory metal such as Mo, W, or Ta or it may be a low thermal conductivity alloy or pure Ni. Preferably, the protrusion is a Fe—Cr18-Ni10 alloy with a thermal conductivity of about 16.3 W/m-K.

The protrusions may be attached to the hollow ferrules with any low thermal conductivity wire and may be welded with resistance welds or laser welds. Alternatively, the assembly may comprise two or more wires. Especially preferred is a Ni80-Cr20 wire with a thermal conductivity of about 13.4 W/m-K. Wire diameters may vary as desired. We have found diameters of 125 and 250 $\mu$m to be satisfactory.

The thermal isolation of the protrusion may be accomplished by the choice of the distance between the protrusion and the ferrule, the number of connections between the protrusion and the hollow electrode, the area of cross-section, and the thermal conductivity of the material of the wire.

In an embodiment of a lamp according to the invention, the protrusion containing emitter is open at both ends or closed at the distal end (i.e. the end away from the discharge), and is positioned inside the lamp envelope. Experiments leading to the invention have shown that the discharge arc enters the hollow ferrule around the protrusion in the case of an emitter applied to the outside surface of the protrusion with one end closed, the closed side facing the hollow ferrule. The lamp envelope then shows slight blackening near the protrusion, since the metal is sputtered. Blackening may be due to the incomplete coverage of the metal with emitter. For this reason, it is preferred that the emitter is present on the inside surface of the protrusion.

In another embodiment of the invention, the protrusion is positioned away from, i.e. toward an end portion of, the lamp envelope. This has the advantage that material sputtered from the protrusion during operation will end up substantially outside the lamp envelope so that the lamp envelope itself remains clear and the lumen output remains high during lamp life.

The oxide emitter materials that may be satisfactorily utilized in the practice of the invention are mixed oxides of Ba, Sr and mixtures thereof with one or more of the metals from the series comprising Ta, Ti, Zr and/or with one or more of several rare earths such as Sc, Y, La, (the lanthanides), such as for example, mixed oxides selected from the group consisting of $Ba_4Ta_2O_9$, $Ba_5Ta_4O_{15}$, $BaY_2O_4$, $BaCeO_3$, $Ba_xSr_{1-x}Y_2O_4$ wherein x ranges from a value of 0 to 1, for example $Ba_{0.5}Sr_{0.5}Y_2O_4$, $Ba_{0.75}Sr_{0.25}Y_2O_4$; $Ba_2TiO_4$, $BaZrO_3$, $Ba_xSr_{1-x}TiO_3$ wherein x ranges from a value of 0 to 1, such as for example, doped and undoped $Ba_{0.5}Sr_{0.5}TiO_3$; and $Ba_xSr_{1-x}ZrO_3$ wherein x ranges from a value of 0 to 1, such as for example $Ba_{0.5}Sr_{0.5}ZrO_3$. The emitter $Ba_{0.5}Sr_{0.5}ZrO_3$ is especially preferred for use in very high current, for example greater than 100 mA ND lamps and $Ba_4Ta_2O_9$ is especially preferred for use in lower current lamps, for example less than 100 mA. Preferably, an emissive material from the group consisting of $Ba_4Ta_2O_9$, $BaY_2O_4$, $BaCeO_3$, $BaY_2O_4$, $BaCeO_3$, $Ba_{0.5}Sr_{0.5}Y_2O_4$, $Ba_{0.75}Sr_{0.25}Y_2O_4$, $Ba_2TiO_4$, $BaZrO_3$, $Ba_{0.5}Sr_{0.5}TiO_3$, and $Ba_{0.5}Sr_{0.5}ZrO_3$ is used.

The emitter materials $Ba_4Ta_2O_9$, $Ba_5Ta_4O_{15}$, and $BaCeO_3$ are novel materials useful in lamp electrodes according to the invention and are particularly unique in possessing excellent emission properties while also being satisfactory in moisture sensitivity properties. The operability of $Ba_4Ta_2O_9$ and $Ba_5Ta_4O_{15}$ is particularly surprising since $Ba_5Ta_2O_9$ is not suitable for use herein due to unsatisfactory moisture sensitivity properties. Cathode fall of ND lamps was calculated by subtracting the calculated arc voltage from measured lamp voltage. Cathode falls in the range of 30–80 V have been achieved with $Ba_{0.5}Sr_{0.5}Y_2O_4$, $Ba_4Ta_2O_9$, $BaCeO_3$, $BaZrO_3$, $Ba_{0.5}Sr_{0.5}TiO_3$ and $Ba_2TiO_4$ emitters in 30–40 mA ND fluorescent lamps after more than 1000 hrs. in continuous burning tests. Cathode falls in the range of 50–150 V were achieved with $Ba_4Ta_2O_9$ and $BaZrO_3$ emitters in 10 mA ND neon lamps after more than 2500 hrs. and 565,500 on/off cycles. According to an embodiment of the invention, there is provided a low pressure discharge lamp, comprising a tubular glass lamp envelope which is closed in a vacuum tight manner and which has end portions;

an ionizable filling (such as for example neon in neon lamps or a mercury vapor in fluorescent lamps), in the lamp envelope;

at least two cylindrical electrodes which enter the lamp envelope each at a respective end portion, ;

d. an electron emissive material disposed on at least one of said electrodes, at least one of the two said electrodes being a hollow cylindrical electrode bearing on at least one of its surfaces an emissive material selected from one or more mixed oxides of Ba, Sr or mixtures thereof with one or more of the metals from the series comprising Ta, Ti, Zr and/or with one or more of several rare earths such as Sc, Y, La. Preferably, such emitter materials are mixed oxides selected from the group consisting of $Ba_4Ta_2O_9$, $Ba_5Ta_4O_{15}$, $BaY_2O_4$, $BaCeO_3$, $Ba_xSr_{1-x}Y_2O_4$ wherein x ranges from a value of 0 to 1; $Ba_2TiO_4$, $BaZrO_3$, $Ba_xSr_{1-x}TiO_3$ wherein x ranges from a value of 0 to 1, and $Ba_xSr_{1-x}ZrO_3$wherein x ranges from a value of 0 to 1. Most preferably, the emitter materials are selected from the group consisting of $Ba_4Ta_2O_9$, $BaY_2O_4$, $BaCeO_3$, $Ba_{0.5}Sr_{0.5}Y_2O_4$, $Ba_{0.75}Sr_{0.25}Y_2O_4$, $Ba_2TiO_4$, $BaZrO_3$, $Ba_{0.5}Sr_{0.5}TiO_3$, and $Ba_{0.5}Sr_{0.5}ZrO_3$.

According to preferred embodiments of the invention, the lamp may have only one hollow electrode provided with an emissive material or with a protrusion bearing an emissive material on its surfaces. Such a lamp with one hollow electrode of the invention is particularly suited for use in DC operation. Preferably, however, for AC operation, two hollow electrodes of the invention are present. The electrodes may be the same or different in construction and in the emissive material coated or otherwise contained thereon or therein. Most preferably, the electrodes are of the same construction and contain the same emissive material on an internal surface or portion thereof, or on an external surface or portion thereof, or on both internal and external surfaces and portions thereof.

Neon lamps have been produced in which the use of emitters in protrusions to the ferrules in accordance with the invention has allowed the lowering of glass temperatures from 230° C. to about 100° C. at 10 mA. This is a consequence of the lower cathode falls that are obtainable with the new electrodes. Additionally, as a result of lower glass temperatures, a cheaper plastic luminaire can be used with these lamps. Especially good results have been obtained with $Ba_4Ta_2O_9$ emitter used in the central high mounted stoplights for automobile brake lights. Due to the low cathode fall, the efficacy of the T1 and neon lamps is increased.

The electrodes described above may also be used in instant start fluorescent and T2 lamps. The advantage of cold starting electrodes is that the ballast costs can be lowered by eliminating the preheating circuit.

DETAILED DESCRIPTION OF PREFERRED EMBODIMENTS

Figure 1:
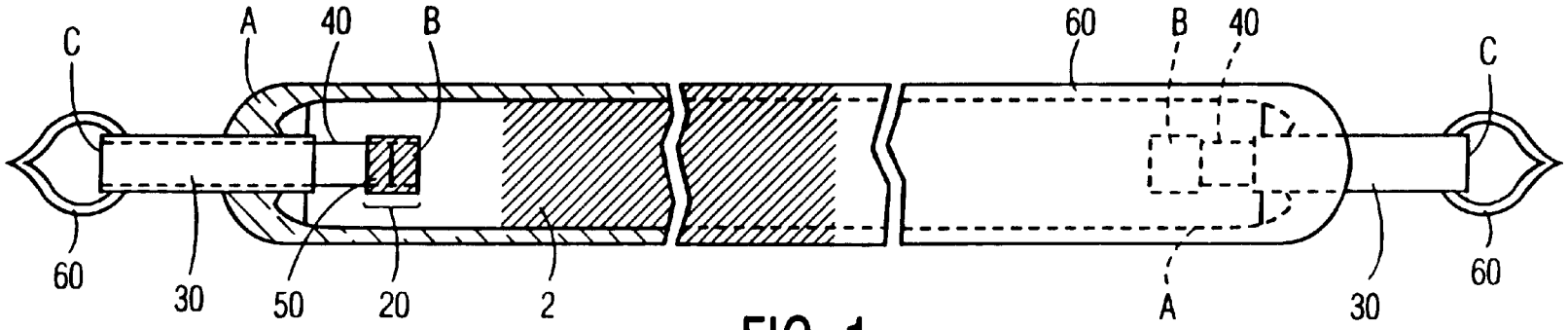
FIG. 1 is a schematic illustration of a low-pressure discharge lamp according to the invention.

With reference to FIG. 1, the low-pressure discharge lamp has a tubular glass lamp envelope 60, a tubular discharge vessel which encloses a discharge space in a vacuum tight manner and has end portions A. It has an ionizable filling comprising rare gas, such as for example argon or neon, or it may contain mercury vapor, depending on the lamp type. A phosphor layer 2 may cover the inner surface or at least a major portion thereof. The discharge vessel is made of glass which transmits the visible radiation generated in the luminescent layer 2. Hollow cylindrical electrodes (ferrules) 30 enter the discharge space of the lamp envelope each at a respective end portion B and have end portions C outside the lamp envelope and closed off with glass.

Figure 2:
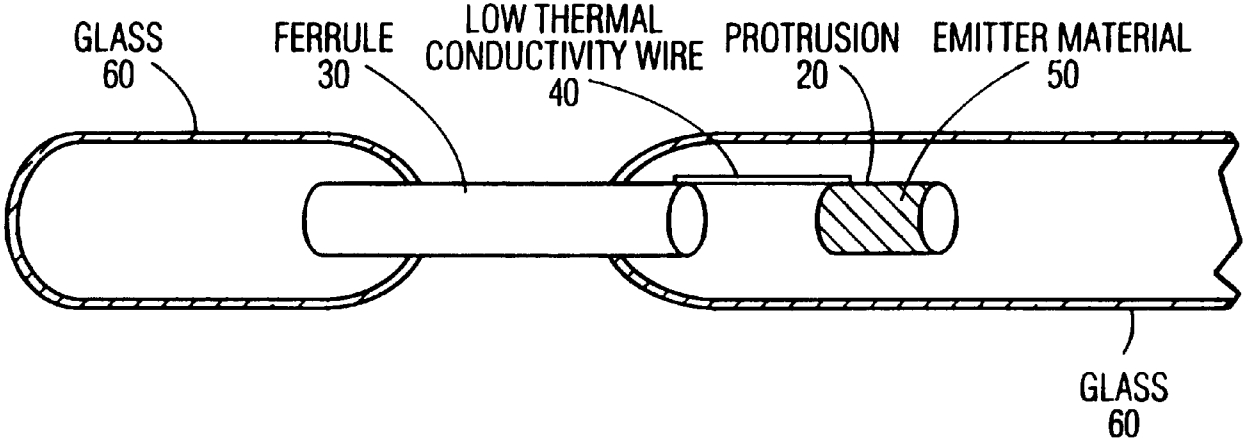
FIG. 2 is a schematic illustration of an electrode comprising a hollow electrode comprising a ferrule with hollow protrusion and wire assembly according to this invention.
Figure 3:
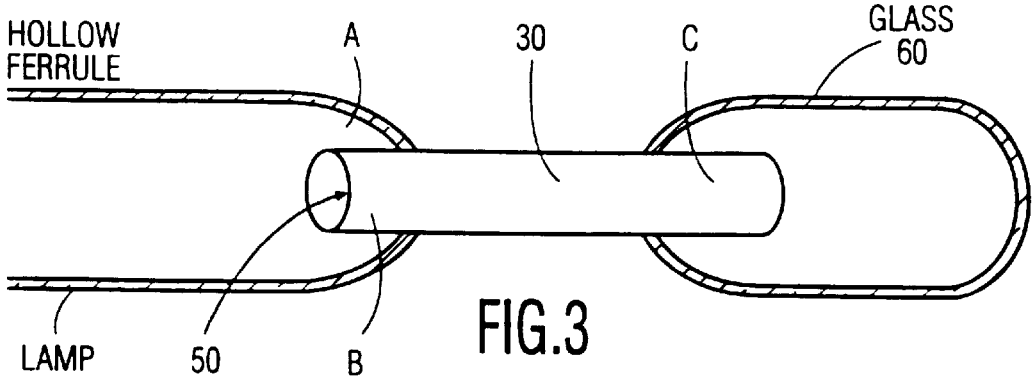
FIG. 3 is a schematic illustration of an electrode comprising a hollow ferrule assembly provided in an axial geometry according to this invention.
Figure 4:
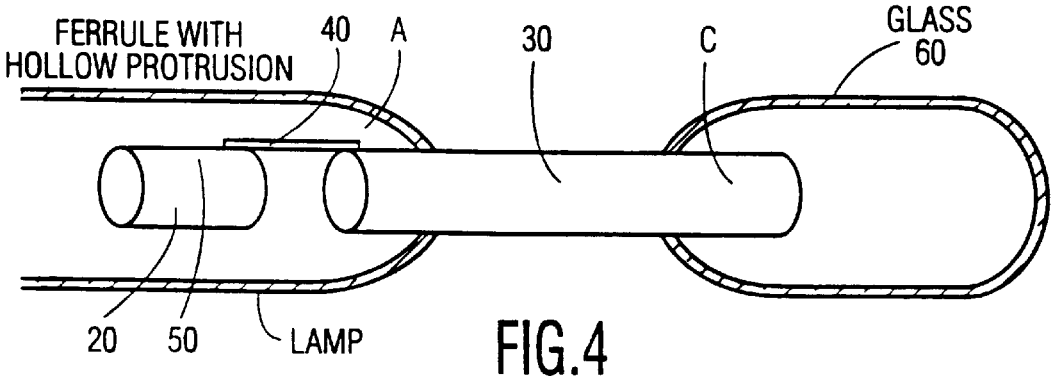
FIG. 4 is a schematic illustration of another electrode comprising a ferrule with hollow protrusion and wire assembly according to this invention.
Figure 5:
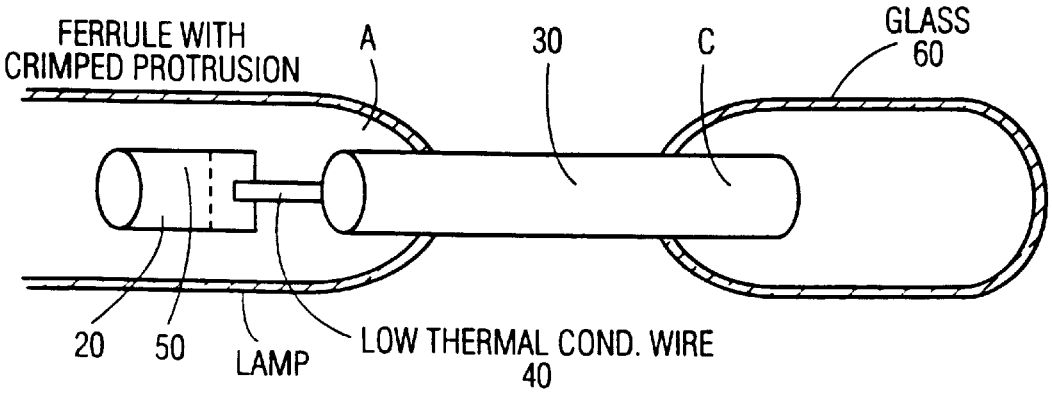
FIG. 5 is a schematic illustration of an electrode comprising a ferrule with protrusion having a crimped end portion and wire assembly provided in an axial geometry according to this invention.

A protrusion 20, shown in detail in FIG. 2, has been laser or resistance welded onto the ferrule 30 with a thermal isolator, for example, a Ni or Ni—Cr wire 40. The protrusion 20 is coated with an electron emitter material 50 on at least one of its surfaces, and preferably on an internal surface.

Lamps were made with the electrodes of the invention and the results are summarized in Tables 1 and 2 below:

TABLE 1

| LAMP | TYPE | EMITTER | ELECTRODE GEOMETRY | LIFE(HRS) | ON/OFF CYCLES |
|---|---|---|---|---|---|
| Neon | Lamps | $Ba_4Ta_2O_9$ | Hollow ferrule with incision | Ongoing after 3500 hrs. | 565,500 |
| Neon | Lamps | $BaZrO_3$ | Ferrule with protrusion | Ongoing after 3500 hrs. | 580,000 |

TABLE 2

CATHODE FALLS DURING LIFETIMES FOR VARIOUS EMITTERS

| | Lifetime [hr] | | | | | |
|---|---|---|---|---|---|---|
| Material | 0 | 500 | 1000 | 2000 | 3000 | 4000 |
| triple oxide* | 24 | 70 | | | | |
| $Ba_{.5}Sr_{.5}TiO_3$ (+$Y_2O_3$) | 30 | 60 | 70 | 65 | 63 | 96 |
| $Ba_{.5}Sr_{.5}TiO_3$ | 64 | 84 | 67 | | | |
| $Ba_{.5}Sr_{.5}TiO_3$ + W*** | 63 | 84 | 74 | | | |
| $BaTiO_3$ + $Ba_2TiO_4$ + W*** | 93 | 160 | 160 | | | |
| $Ba_{.5}Sr_{.5}Y_2O_4$** | 80 | 82 | 88 | | | |
| $BaY_2O_4$ | 31 | 68 | 75 | | | |
| $BaZrO_3$ | 27 | 30 | 40 | 45 | 75 | 45 |
| $BaTiO_4$ | 34 | 43 | 43 | 45 | 45 | 40 |
| $Ba_4CaAl_2O_8$ | 157 | | | | | |
| $BaCeO_3$ | 30 | 45 | 48 | 45 | 44 | 45 |
| $Ba_4Ta_2O_9$ | 30 | 45 | 42 | 45 | 44 | 45 |
| $LaB_6$ | 40 | | | | | |

The experiments were performed under continuous operation at 30 mA.
*Other experiments indicate that the triple oxide has a stable lifetime and 5000 hrs. are achieved with a cathode fall of about 35 volts.
**The high cathode fall of lamps with this emitter is attributed to impurities in the gas phase. However during life test little deposition took place in these lamps.
***Electrodes were made of protrusions with a tungsten bar mounted in the middle. The higher cathode fall is probably due to a lower temperature of the protrusion.

Additionally, the increase in lamp voltage over life is small with $Ba_4Ta_2O_9$ emitter. Good lamp performance was also found with $BaZrO_3$, $BaY_2O_4$, $BaCeO_3$, $Ba_{0.5}Sr_{0.5}Y_2O_4$, and $Ba_{0.75}Sr_{0.25}Y_2O_4$.

ND fluorescent lamps were made with a cup shaped protrusion filled with various emitters and also with triple carbonates (for comparison). $BaZrO_3$, $Ba_4Ta_2O_9$, $Ba_2TiO_4$ and other emitters used need not be activated and show no moisture uptake even after prolonged exposure to air. Triple carbonates and uncoated (emitterless) ferrules were taken as a reference. All emitters were added via suspension to the electrode. The lamps were made of glass with an inner diameter of 3.5 mm and outer diameter of 5.1 mm. The electrode distance was 12 cm and the filling pressure was 40 mbar argon and mercury.

Similarly, neon lamps were made with a cup shaped protrusion filled with various emitters and also with triple carbonates (for comparison). $BaZrO_3$, $Ba_4Ta_2O_9$, $Ba_2TiO_4$ and other emitters used need not be activated and show no moisture uptake even after prolonged exposure to air. Triple carbonates and uncoated (emitterless) ferrules were taken as a reference. All emitters were added via suspension to the electrode. The lamps were made of glass with an inner diameter of 3.0 mm and outer diameter of 4.2 mm. The electrode distance was 39 cm and the filling pressure was 25 mbar neon.

Figure 6:
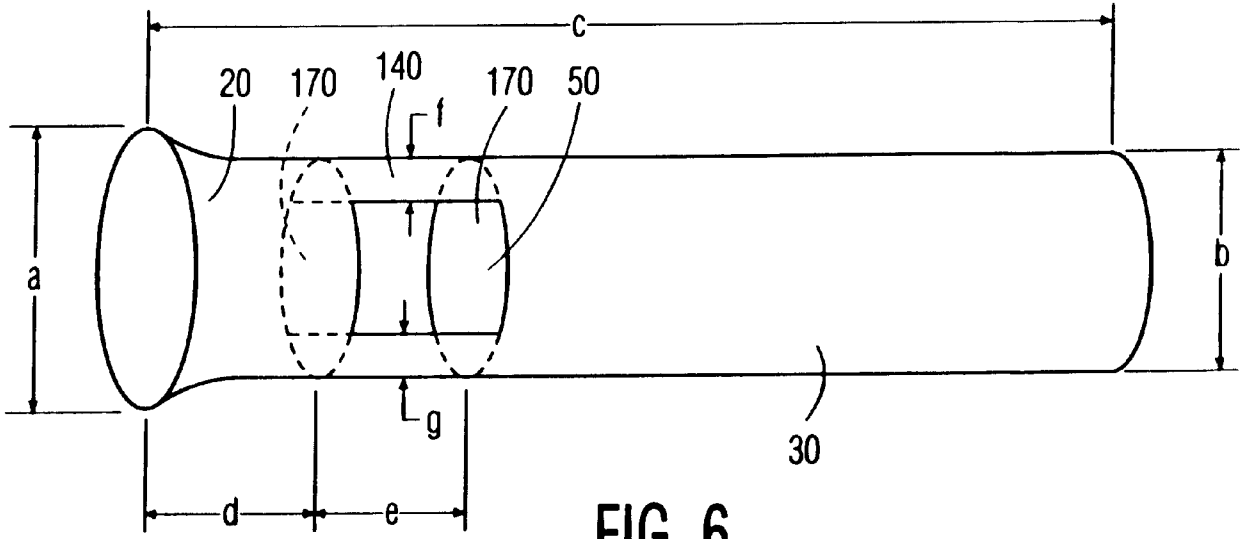
FIG. 6 is a schematic illustration of an electrode comprising a hollow ferrule incisions or cut outs forming the protrusion and wire assembly provided in an axial geometry according to this invention.
Figure 7:
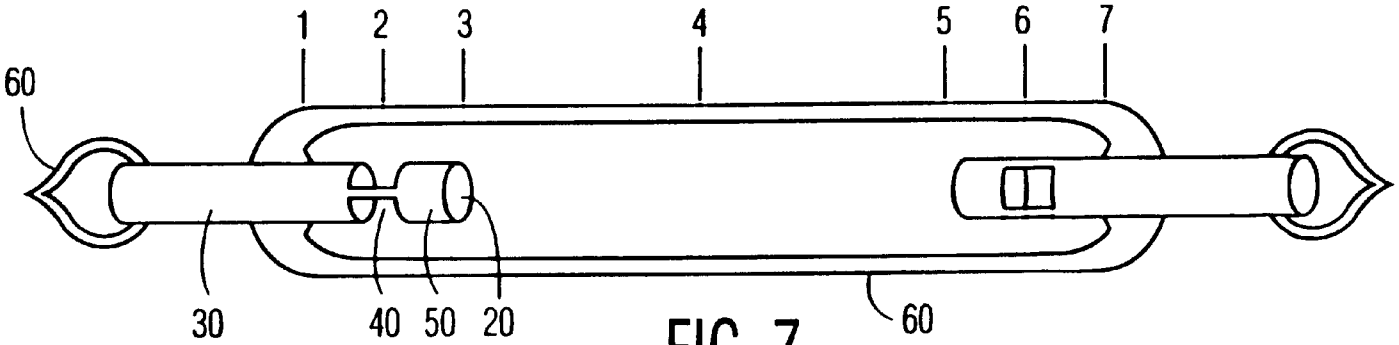
FIG. 7 is a schematic illustration of a neon lamp of the invention showing the various positions on the lamp envelope along which temperature measurements were made and recorded.

With reference to FIG. 6, an electrode was made having a length (c); a flare end (a); and an end (b). A protrusion having a length (d) was made via incisions in the ferrule resulting in two openings or cut away portions 170 having a length (e) resulting in a bridge (area left after incision) having a width (f,g) that connects the protrusion to the ferrule. In this example, the protrusion length was about 2 mm and the incision width was about 1 mm. With reference to FIG. 7, temperature measurements were performed after ten minutes of continuous lamp operation in the case of neon lamps and operated at 10 mA in DC mode. The results are listed below in Table 3 which lists values that are the mean of eight different electrodes in four lamps. Two different electrode geometries were tested with $Ba_4Ta_2O_9$: (I) with the incision and (II) a ferrule without a protrusion or incision, but coated with the emitter material on the inside surface. The numbers 1 through 7 indicate various positions along the glass leading up to the cathode region as illustrated in FIG. 7.

TABLE 3

TEMPERATURE OF THE GLASS WALL OF NEON LAMPS (10 mA DC)

| | Temperature (C) at glass position No. | | | | | | |
|---|---|---|---|---|---|---|---|
| ELECTRODE | 1 | 2 | 3 | 4 | 5 | 6 | 7 |
| Life time, 1 hr. | | | | | | | |
| ferrule (ref) | 60 | 60 | 60 | 50 | 177 | 177 | 230 |
| $BaZrO_3$ | 52 | 72 | 80 | 48 | 95 | 83 | 59 |
| triple carbonate | 45 | 55 | 63 | 47 | 124 | 120 | 71 |
| $Ba_4Ta_2O_9$ I | 44 | 46 | 46 | 46 | 100 | 104 | 102 |
| $Ba_4Ta_2O_9$ II | 66 | 70 | 77 | 54 | 120 | 130 | 150 |
| Life time, 400 hr. | | | | | | | |
| ferrule (ref) | | | | | | | |
| $BaZrO_3$ | 43 | 49 | 57 | 52 | 70 | 77 | 67 |
| triple carbonate | 47 | 55 | 58 | 55 | 127 | 139 | 85 |
| $Ba_4Ta_2O_9$ I | 60 | 66 | 72 | 54 | 103 | 111 | 115 |
| $Ba_4Ta_2O_9$ II | 66 | 71 | 75 | 54 | 121 | 142 | 160 |

The maximum temperature of the lamp envelope is decreased by using electrodes with protrusions and emitters with a low work function. Both the triple carbonates, activated using rf-heating, or $BaZrO_3$ result in a much lower maximum temperature. The position of the maximum temperature has changed from near the electrode glass interface (7) in the reference ferrule with no emitter towards the position around the top of the protrusion (5,6) in electrodes containing the emitter as a direct consequence of lowered cathode fall. Additionally, it was found that the temperatures of the emitterless ferrules (ref) are the highest. Coating of the ferrules result in a decrease of the temperature by about 80° C. However, a protrusion results in even lower temperatures (by about 130° C.). This makes it possible to use cheaper plastic materials as luminaires. Electrodes with an incision have a slightly higher temperature than those with a separately attached protrusion as a result of the geometry of the electrode. The electrode with the incision has two connecting portions as a result of the incision resulting in an enhanced heat transport to the back of the electrode, thus resulting in a slightly higher end temperature. By changing the geometry of the incision, the maximum temperature can be lowered to the same value as with the electrodes with a protrusion. Measurements after prolonged operation showed that the wall temperatures do not change much during lifetime.

The invention may be embodied in other specific forms without departing from the spirit and scope or essential characteristics thereof, the present disclosed examples being only preferred embodiments thereof.

We claim:

1. An electrode assembly which comprises at least one hollow cylindrical ferrule formed from a high temperature resistant alloy or a refractory metal having an emitter material on at least one surface thereof, said emitter material being a mixed oxide of Ba, Sr and mixtures thereof with one or more of the metals from the series comprising Ta, Ti, Zr, Sc, Y, and La selected from the group consisting of $BaY_2O_4$, $Ba_xSr_{1-x}Y_2O_4$, $Ba_2TiO_4$, $BaZrO_3$, $Ba_xSr_{1-x}TiO_3$, and $Ba_xSr_{1-x}ZrO_3$, wherein x ranges from a value of 0 to 1.

2. An electrode assembly as claimed in claim 1, wherein the emitter material is one or more mixed oxides selected from the group consisting of $BaY_2O_4$, $Ba_{0.5}Sr_{0.5}Y_2O_4$, $Ba_{0.75}Sr_{0.25}Y_2O_4$, $Ba_2TiO_4$, $BaZrO_3$, $Ba_{0.5}Sr_{0.5}TiO_3$, and $Ba_{0.5}Sr_{0.5}ZrO_3$.

3. An electrode assembly as claimed in claim 2, wherein the electrode is capable of use in a discharge lamp without in-lamp processing.

4. An electrode assembly which comprises at least one hollow cylindrical ferrule having a protrusion containing an emitter material on at least one of its surfaces, said ferrule being attached to said protrusion via a thermal isolator, wherein the emitter material in said protrusion is a mixed oxide being a mixed oxide of Ba, Sr and mixtures thereof with one or more of the metals from the series comprising Ta, Ti, Zr, Sc, Y, and La.

5. An electrode assembly as claimed in claim 4, wherein the emitter material is one or more mixed oxides selected from the group consisting of $Ba_4Ta_2O_9$, $Ba_5Ta_4O_{15}$, $BaY_2O_4$, $BaCeO_3$, $Ba_xSr_{1-x}Y_2O_4$, $Ba_2TiO_4$, $BaZrO_3$, $Ba_xSr_{1-x}TiO_3$, and $Ba_xSr_{1-x}ZrO_3$, wherein x ranges from a value of 0 to 1.

6. An electrode assembly as claimed in claim 4, wherein the emitter material is one or more mixed oxides selected from the group consisting of $Ba_4Ta_2O_9$, $BaY_2O_4$, $BaCeO_3$, $Ba_{0.5}Sr_{0.5}Y_2O_4$, $Ba_{0.75}Sr_{0.25}Y_2O_4$, $Ba_2TiO_4$, $BaZrO_3$, $Ba_{0.5}Sr_{0.5}TiO_3$, and $Ba_{0.5}Sr_{0.5}ZrO_3$.

7. An electrode assembly as claimed in claim 4, wherein the electrode is capable of use in a discharge lamp without in-lamp processing.

8. An electrode assembly as claimed in claim 4, wherein said thermal isolator is a low conductivity metal wire.

9. An electrode assembly as claimed in claim 8, wherein said thermal isolator is a low conductivity metal wire.

10. An electrode assembly which comprises at least one hollow cylindrical ferrule having a protrusion with a receptacle portion containing an emitter material, said ferrule being attached to said protrusion via a thermal isolator, wherein the emitter material in said protrusion is a mixed oxide being a mixed oxide of Ba, Sr and mixtures thereof with one or more of the metals from the series comprising Ta, Ti, Zr, Sc, Y, and La.

11. An electrode assembly as claimed in claim 10, wherein the emitter material is one or more mixed oxides selected from the group consisting of $Ba_4Ta_2O_9$, $Ba_5Ta_4O_{15}$, $BaY_2O_4$, $BaCeO_3$, $Ba_xSr_{1-x}Y_2O_4$, $Ba_2TiO_4$, $BaZrO_3$, $Ba_xSr_{1-x}TiO_3$, and $Ba_xSr_{1-x}ZrO_3$, wherein x ranges from a value of 0 to 1.

12. An electrode assembly as claimed in claim 10, wherein the emitter material is one or more mixed oxides selected from the group consisting of $Ba_4Ta_2O_9$, $BaY_2O_4$, $BaCeO_3$, $Ba_{0.5}Sr_{0.5}Y_2O_4$, $Ba_{0.75}Sr_{0.25}Y_2O_4$, $Ba_2TiO_4$, $BaZrO_3$, $Ba_{0.5}Sr_{0.5}TiO_3$, and $Ba_{0.5}Sr_{0.5}ZrO_3$.

13. An electrode assembly as claimed in claim 12, wherein the electrode is capable of use in a discharge lamp without in-lamp processing.

14. An electrode assembly as claimed in claim 10, wherein said thermal isolator is a low conductivity metal wire.

15. An electrode assembly as claimed in claim 13, wherein said thermal isolator is a low conductivity metal wire.

16. An electrode assembly which comprises at least one hollow cylindrical ferrule having a protrusion containing an emitter material on at least one of its surfaces, the ferrule and protrusion being integrally formed, the protrusion being connected to the ferrule by material remaining after removal of material from a surface portion of the ferrule, wherein the emitter material in said protrusion is a mixed oxide being a mixed oxide of Ba, Sr and mixtures thereof with one or more of the metals from the series comprising Ta, Ti, Zr, Sc, Y, and La.

17. An electrode assembly as claimed in claim 16, wherein the emitter material is one or more mixed oxides selected from the group consisting of $Ba_4Ta_2O_9$, $Ba_5Ta_4O_{15}$, $BaY_2O_4$, $BaCeO_3$, $Ba_xSr_{1-x}Y_2O_4$, $Ba_2TiO_4$, $BaZrO_3$, $Ba_xSr_{1-x}TiO_3$, and $Ba_xSr_{1-x}ZrO_3$, wherein x ranges from a value of 0 to 1.

18. An electrode assembly as claimed in claim 16, wherein the emitter material is one or more mixed oxides selected from the group consisting of $Ba_4Ta_2O_9$, $BaY_2O_4$, $BaCeO_3$, $Ba_{0.5}Sr_{0.5}Y_2O_4$, $Ba_{0.75}Sr_{0.25}Y_2O_4$, $Ba_2TiO_4$, $BaZrO_3$, $Ba_{0.5}Sr_{0.5}TiO_3$, and $Ba_{0.5}Sr_{0.5}ZrO_3$.

19. An electrode assembly as claimed in claim 16, wherein the electrode is capable of use in a discharge lamp without in-lamp processing.

20. An electrode assembly as claimed in claim 16 wherein the material is removed from the ferrule by incision such as by sawing, grinding, drilling, or etching a surface portion thereof.

21. An electrode assembly which comprises at least one hollow cylindrical ferrule comprising a metal or alloy selected from the group of Fe—Ni—Cr alloy, Mo, W, Ta and alloys thereof, having an emissive material on at least one surface thereof, said emissive material being selected from the group consisting of $Ba_2TiO_4$, $BaZrO_3$, and $Ba_{0.5}Sr_{0.5}ZrO_3$, said electrode being capable of use in a high current discharge lamp without in-lamp processing.

22. An electrode assembly which comprises at least one hollow cylindrical ferrule comprising a metal or alloy selected from the group of Fe—Ni—Cr alloy, Mo, W, Ta and alloys thereof, having an emissive material on at least one surface thereof, said emissive material being selected from the group consisting of $Ba_2TiO_4$, $BaZrO_3$, and $Ba_{0.5}Sr_{0.5}ZrO_3$, said electrode being capable of use in a high current discharge lamp without in-lamp processing.

23. An electrode assembly which comprises at least one hollow cylindrical ferrule comprising a metal or alloy selected from the group of Fe—Ni—Cr alloy, Mo, W, Ta and alloys thereof, a hollow protrusion bearing an emitter material on at least one of its surfaces being attached to the ferrule by a thermal isolator, said emitter material being selected from the group consisting of $Ba_4Ta_2O_9$, $Ba_2TiO_4$, $BaZrO_3$, and $Ba_{0.5}Sr_{0.5}ZrO_3$, said electrode being capable of use in a high current discharge lamp without in-lamp processing.

24. An electrode assembly as claimed in claim 23 wherein the thermal isolator is a Ni80-Cr20 wire.

25. An electrode assembly which comprises at least one hollow cylindrical ferrule comprising a metal or alloy selected from the group of Fe—Ni—Cr alloy, Mo, W, Ta and alloys thereof having a hollow protrusion portion bearing an emitter material on at least one surface thereof, the protrusion and the ferrule being integrally formed, the protrusion portion being connected to the ferrule by portions of the ferrule that remain after the removal of other portions of the ferrule, said emitter material being selected from the group consisting of $Ba_4Ta_2O_9$, $Ba_2TiO_4$, $BaZrO_3$, and $Ba_{0.5}Sr_{0.5}ZrO_3$, said electrode being capable of use in a high current discharge lamp without in-lamp processing.

* * * * *